US006115454A

United States Patent [19]

Andrews et al.

[11] Patent Number: 6,115,454

[45] **Date of Patent: *Sep. 5, 2000**

[54] HIGH-PERFORMANCE X-RAY GENERATING APPARATUS WITH IMPROVED COOLING SYSTEM

[75] Inventors: Gregory C. Andrews, Sandy; Dennis H. Runnoe, Salt Lake City; John E. Richardson, Salt Lake City; James R. Boye, Salt Lake City, all of Utah

[73] Assignee: Varian Medical Systems, Inc., Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,701

[22] Filed: Aug. 6, 1997

[51] Int. Cl.[7] ..... H01J 5/18

[52] U.S. Cl. ..... 378/140; 378/141

[58] Field of Search ..... 378/140, 141

[56] References Cited

U.S. PATENT DOCUMENTS 4,309,637 1/1982 Fetter ..... 378/140
4,916,015 4/1990 Schaffner et al. ..... 378/141
4,943,989 7/1990 Lounsberry et al. ..... 378/130
5,689,542 11/1997 Lavering et al. ..... 378/130

*Primary Examiner*—Craig E. Church
*Attorney, Agent, or Firm*—Workman, Nydegger & Seeley

[57] ABSTRACT

An X-ray generation apparatus has a housing comprising an evacuated envelope with a rotatable anode target surrounded by an all metal grounded exterior structure and a cooling system. The cooling system comprises a coolant circulating system with heat exchanger and means for circulating a fluid coolant through an interior of the X-ray generating apparatus; a hollow shield structure with center aperture for passing and electron beam; and a cooling block which is disposed proximate to the rotatable anode target and comprises a disk with a plurality of concentric annular channels formed by concentric annular partitions. The shield structure and the disk of the cooling block are made of thermally conductive material. An interior of the shield structure is filled with structures such as pins, fins or pack bed which are made of thermally conductive materials. The fluid coolant is circulated through the shield structure, then into the plurality of channels of the cooling block and via an interior of the housing to the heat exchanger for efficient cooling of the X-ray generating apparatus.

7 Claims, 5 Drawing Sheets

HIGH-PERFORMANCE X-RAY GENERATING APPARATUS WITH IMPROVED COOLING SYSTEM

FIELD OF THE INVENTION

This invention relates to high-performance X-ray generating apparatus and, more particularly, to X-ray generating apparatus with high patient throughput.

BACKGROUND OF THE INVENTION

Conventional X-ray generating apparatus generally consist of an outer housing containing a vacuum envelope with cathode and anode electrodes which are spaced axially. Electrons are launched from a hot tungsten filament and gain energy by traversing the gap between the cathode and the anode with a strong electric field. The electrons strike an anode target with a material of a high atomic number such as tungsten and rhenium, and X-ray are created during the rapid deceleration and scattering of the electrons therein. However, only a very small fraction of the kinetic energy of the impinging electrons is converted into X-rays, while the remaining energy is being converted into heat. As a result, the target material heats up rapidly at the point of electron impact. To dissipate or distribute the heat the anode is usually adapted to rotate inside the vacuum envelope so that the heated spot on the electron-receiving surface of its target will be spread over a large area. The patient throughput of an X-ray generating apparatus is substantially limited by the ability to cool down its X-ray tube. Most conventional Computerized Tomography (CT) X-ray tubes use one-second scanning protocols as maximum scanning rate. An efficient removal of heat from the rotating target is one of the main problems of successful utilization of these CT X-ray tubes in CT scanners.

SUMMARY OF THE INVENTION

It is a main object of the present invention to provide a high-performance X-ray generating apparatus with high patient throughput having an improved cooling system.

It is a more specific object of the present invention to provide an X-ray generating apparatus which allows for increasing the fluid through its components thereby increasing the heat transfer through the cooling system which can use sub-second scanning protocols utilizing the improved cooling system.

It is another object of the present invention to provide an X-ray generating apparatus with an improved cooling system capable of substantially reducing patient throughput constraints on prior art X-ray generating apparatus.

X-ray generating apparatus embodying this invention, with which the above and other objects can be accomplished, comprises a housing with an evacuated envelope having an electron source and a rotatable anode target which are spaced from each other and a cooling system. The cooling system comprises a hollow shield structure, a cooling block and an external cooling unit having means for circulating a fluid coolant and a heat exchanger. A hollow shield structure is placed between the electron source and the anode target for reducing the heat load of the anode structure and to capture back-scattered secondary electrons causing off-focal radiation. A plurality of fins or pins are incorporated within an interior of the shield structure to increase a heat dissipation thereof. A metal foam may be placed between the fins. According to one of the embodiments, a cavity of the hollow shield structure may be filled in completely with thermally conductive foam. The cooling block is disposed proximately to the rotatable anode target and comprises a disk with a plurality of annular parallel channels formed by a plurality of annular parallel partitions therebetween. By directing the fluid coolant through the parallel channels of the cooling block, the fluid velocity is reduced thereby reducing friction losses and the associated pressure drop. The means for circulating the fluid coolant forces the coolant through the hollow shield structure, then through the plurality of channels of the cooling block disk and via the interior of the housing to the heat exchanger.

BRIEF DESCRIPTION OF DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
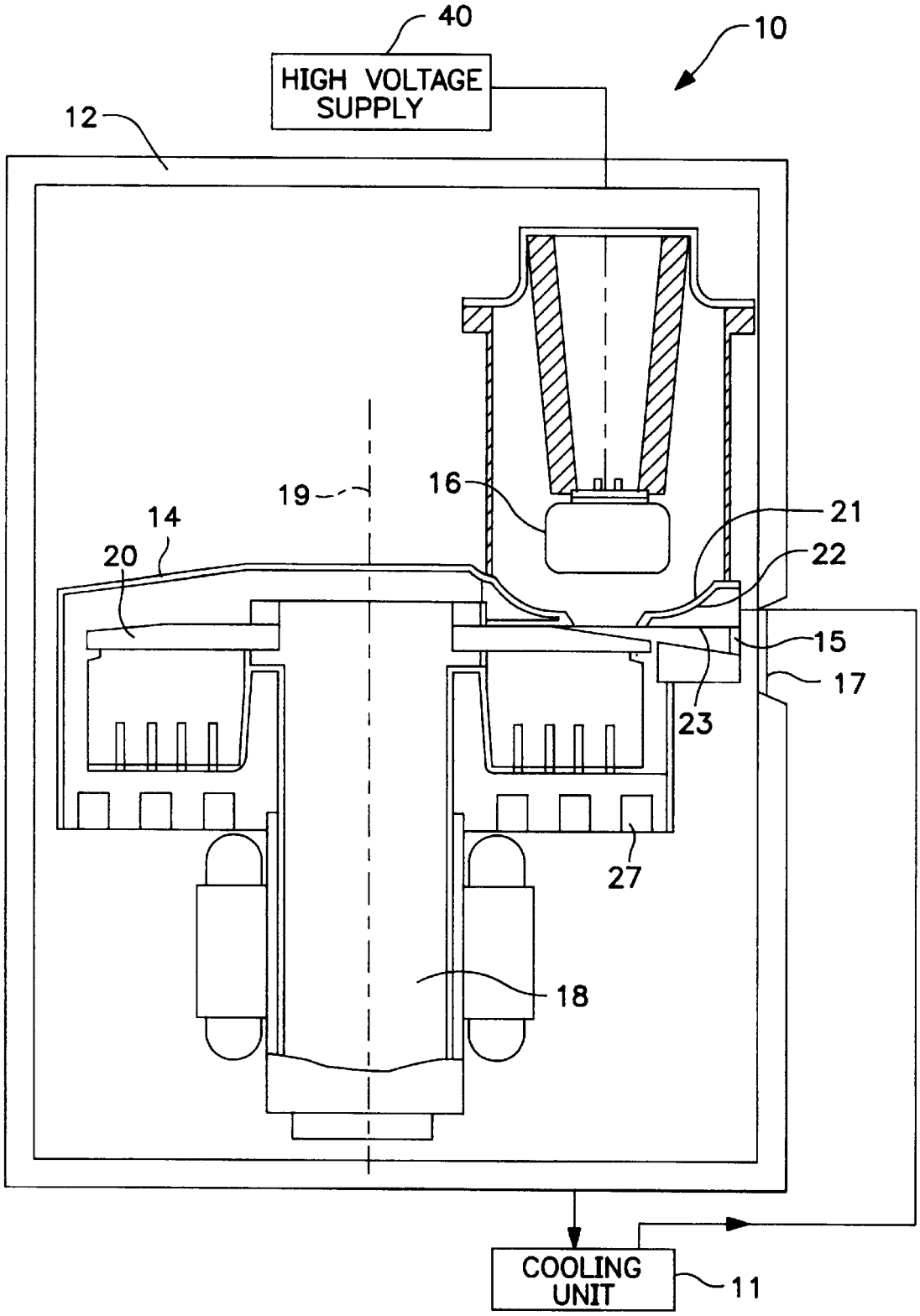
FIG. 1 is a schematic cross-sectional view of an X-ray generating apparatus embodying the present invention.

FIG. 1 shows generally X-ray generating apparatus 10 incorporating an improved cooling system according to the present invention, comprising housing 12 with evacuated envelope 14. Evacuated envelope 14 includes electron source 16 and rotatable anode assembly 18 having anode target 20. Evacuated envelope 14 and housing 12 respectively have windows 15 and 17. Electrons from electron source 16 impinges on anode target 20 which rotates with anode assembly 18 around its axis of rotation 19, and X-rays generated thereby can escape through windows 15 and 17.

The cooling system of X-ray generating apparatus 10 comprises annular shield structure 22, cooling block 27 and coolant unit 11 which comprises a heat exchanger and a pump (not shown) for circulating a fluid coolant from the heat exchanger via shield structure 22 to cooling block 27 and through an interior of housing 12.

Figure 2:
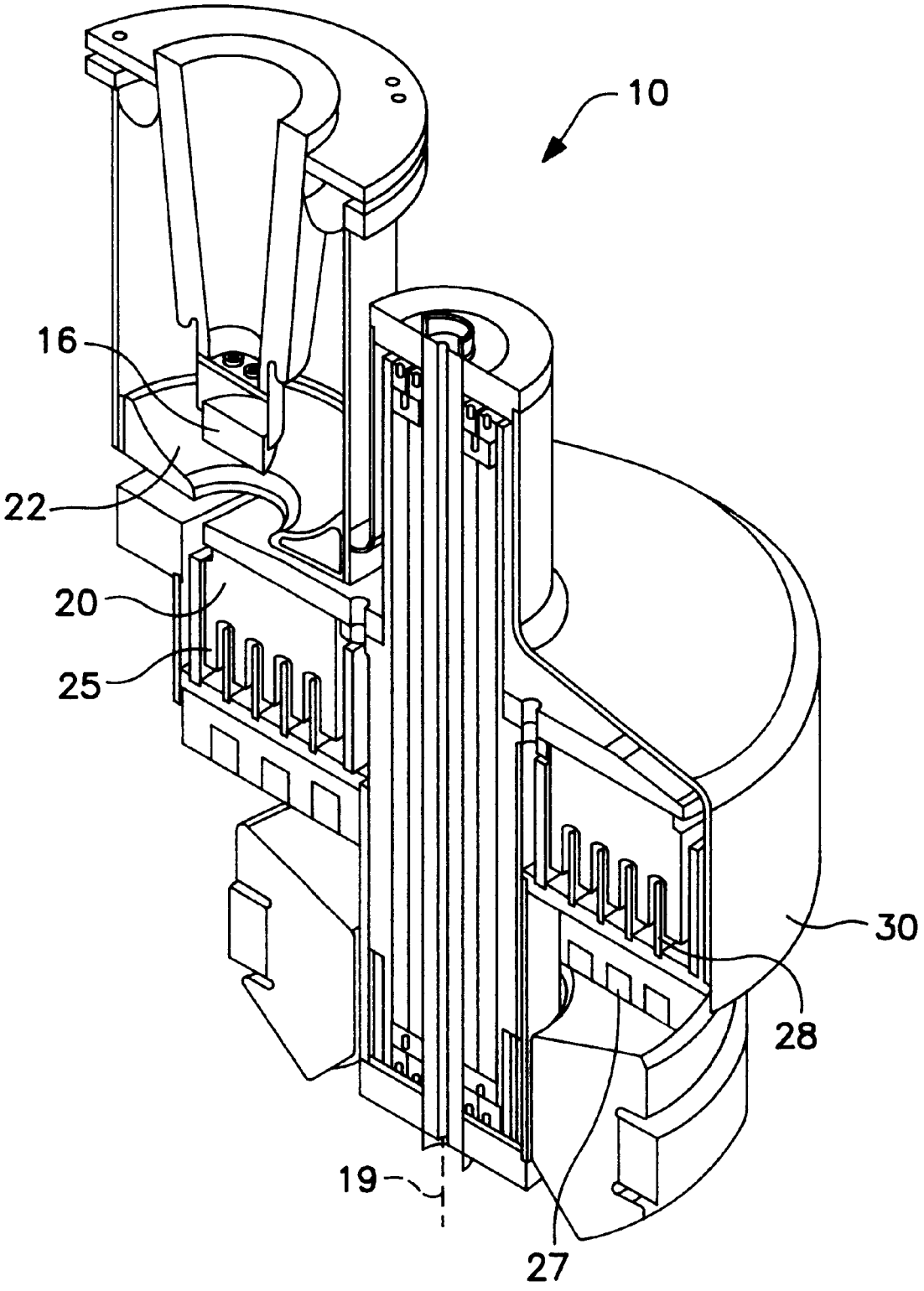
FIG. 2 is a partially cut-away isometric view of a portion of the X-ray generating apparatus of FIG. 1.

In order to protect anode target 20 from the back-scattered electrons and for heat transfer purposes, annular shield structure 22 made of a thermally conductive material, such as copper, is provided between electron source 16 and anode target 20. As shown in FIG. 2, this shield structure 22 has a concave top surface 21 which faces electron source 16, and a flat bottom surface 23 which faces the anode target 20, and a cylindrical opening for allowing electrons from electron source 16 to pass there through towards anode target 20. The interior of shield structure 22 is hollow, serving as a passageway for a cooling fluid. The impinging electrons heat anode target 20, and the heat is radiated by anode target 20 to evacuated envelope 14. Shield structure 22 serves to substantially reduce the target heat load by conducting heat to the cooling fluid which flows therethrough. The principal design and benefits of utilizing the shield structure between the electron source and the target are disclosed in the U.S. patent application Ser. No. 08/660,617 "X-ray Generating Apparatus with a Heat Transfer Device" assigned to the Assignee of the present invention.

Figure 3A:
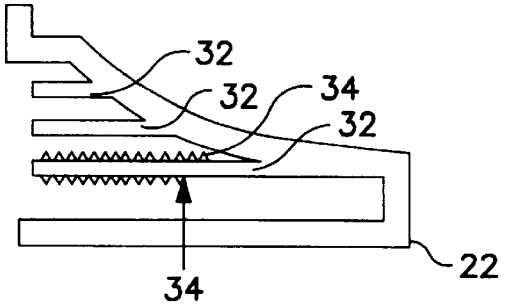
FIG. 3*a* is a schematic cross-sectional view of a shield structure with a plurality of fins incorporated therein.
Figure 3B:
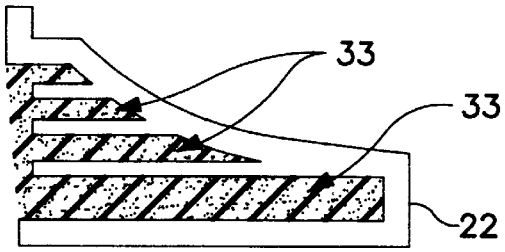
FIG. 3*b* is a schematic cross-sectional view of the shield structure with a plurality of fins within its interior and thermally conductive foam placed between the fins.

In order to enhance the cooling performance of the shield structure and increase the heat transfer area, according to the embodiment shown in FIG. 3*a*, a plurality of fins 32 are provided inside shielding structure 22. The space between fins may be filled in with a metal foam such as copper foam 33 as shown in FIG. 3*b*. Also the fins may be constructed such that they incorporate "knurling" or irregularities 34 on outer surfaces of the fin's disk as shown in FIG. 3*a*. The foam and the knurling increase the heat transfer rate by increasing the wetted area and increases the number of nucleate boiling sites. The heat transfer rate may also be increased by sand blasting the wetted areas to give them a roughened surface for obtaining additional wetting surface and nucleate boiling sites.

Figure 3C:
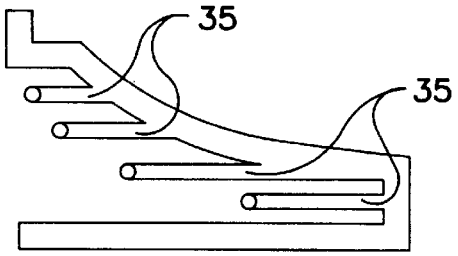
FIG. 3*c* is a schematic cross-sectional view of the shield structure with a plurality of pins incorporated therein.
Figure 3D:
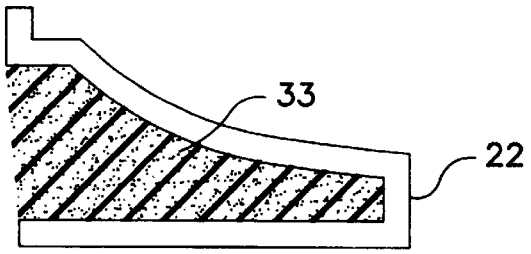
FIG. 3*d* is a schematic cross-sectional view of the shield structure which is filled with a thermally conductive foam.

The fins may be slit in the axial direction to form pins 35 as shown in FIG. 3*c*. According to yet another embodiment shown in FIG. 3*d* the entire hollow cavity formed by shield structure 22 may be filled with metal foam 33. Metal foam 33 is preferably composed of copper and brazed to the interior surface of shield structure 22.

Figure 3E:
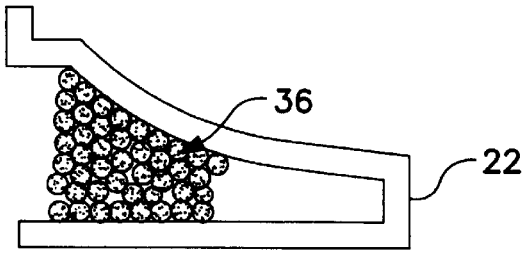
FIG. 3*e* is a schematic cross-sectional view of the shield structure filled with thermally conductive spheres which are brazed therebetween to form a pack bed structure which is connected to the inner walls of the shielded structure.

According to still another embodiment, the cavity of shield structure 22 may be filled with spheres made of thermally conductive material, brazed therebetween so as to form a pack bed 36 configuration and attached preferably by brazing to the inside walls of the shield structure as shown in FIG. 3*e*.

Shield structure 22 is heated also due to the secondary electron bombardment on its concave top surface 21 as well as at the tip abutting the opening at its center. To further enhance the performance of the apparatus 10, selective coatings may be applied to the shield structure 22. The concave top surface 21 may be coated with a material having a low atomic number for effective electron collection. The bottom surface 23 may be coated with a material having a high absorptivity to increase the heat transfer from the target 20.

Figure 4A:
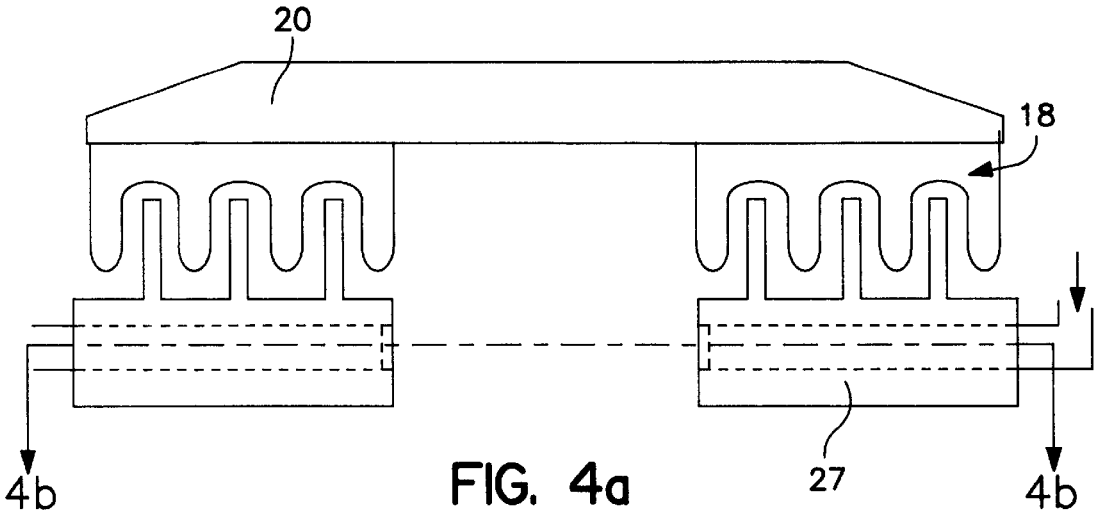
FIG. 4*a* is a schematic cross-sectional view of an anode assembly with a cooling block of the X-ray generating apparatus of the present invention.
Figure 4B:
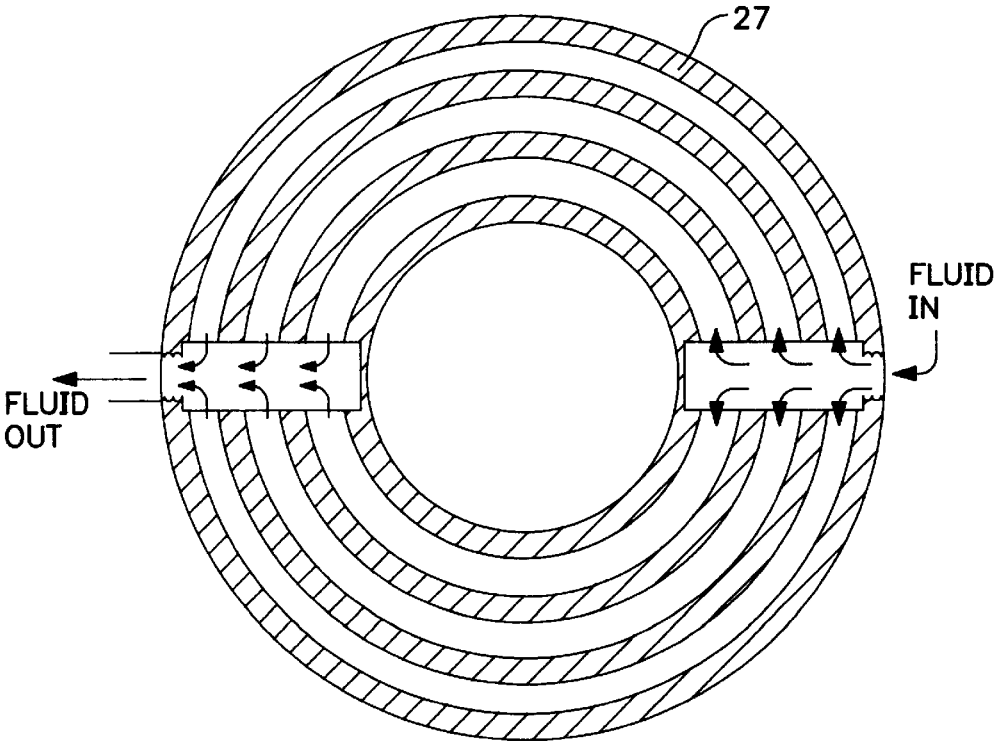
FIG. 4*b* is a sectional view of the cooling block of the X-ray generating apparatus of the present invention taken along the line A—A.

As shown in FIG. 2, anode target 20 has fins 25 which protrude backward towards a cooling block 27 disposed behind the anode assembly 18 (shown in FIG. 1). Cooling block 27 is adapted to be cooled by a fluid coolant which flows therethrough and is provided with forward protrusions 28. When anode target 20 is rotated, anode target fins 25 pass between the forward corresponding protrusions 28 from cooling block 27 for increasing heat transfer from anode assembly 18 to cooling block 27. In FIG. 4*a* cooling block 27 is disposed behind anode assembly 18. As better seen in FIG. 4*b*, cooling block 27 comprises several parallel flow paths which are formed by annular partitions for distribution of the fluid coolant therein. Such distribution of the fluid coolant within concentric annular paths reduces the fluid coolant pressure drop through cooling block 27 thereby increasing the fluid flow through shield structure 22 which leads to increasing the heat transfer throughout the entire cooling system.

Rotatable anode assembly 18 is surrounded by all metal grounded exterior structure 30. Dual ended high voltage conventionally used for prior art X-ray generating apparatus prevents intimate cooling of the anode because the distance between fins 25 and the protrusions in the cooling block is too small to withstand the anode assembly high voltage. With a grounded anode assembly, anode target 20 has more surface area to radiate heat from cooling block 27. Another advantage of grounding the anode is that the quantity of the back-scattered electrons leaving the surface of the target and collected by shield structure 22 increases significantly, further reducing the amount of heat the anode and windows must absorb as well as reducing the amount of off-focal radiation produced. As much as 40% of the total waste energy is collected by shield structure 22 in a grounded anode tube as compared to 15% with metal center section dual ended X-ray tube and 0% in X-ray tubes having a glass envelope. Another advantage of grounding the anode is that the high voltage is confined in the cathode area of the X-ray tube. Means for applying a high negative voltage 40 to the cathode area provides a strong electric field between electron source 16 and anode target 20, which serves to accelerate the emitted electrons from electron source 16 towards anode target 20.

In a vast majority of CT X-ray generating apparatus, mineral oil is used as a heat transfer medium. If this type of oil is subjected to temperature above its boiling point, it will degrade and form deposits on hot surfaces within the cooling system. The deposits materials will cause inefficiencies in the cooling performance of surfaces. According to this invention, a fluid coolant composed of a water based solution or synthetic cooling fluid is used to facilitate deposit-free cooling within the X-ray tube and the housing thereof. Examples of a coolant liquid, which may be used advantageously according to this invention, comprise SylTherm (trade name owned by Dow Chemical Company) which is a modified polydimethylsiloxane water, water glycol mixture, Flourinert electronic cooling fluid (Flourinert is a 3M trade name).

Figure 5:
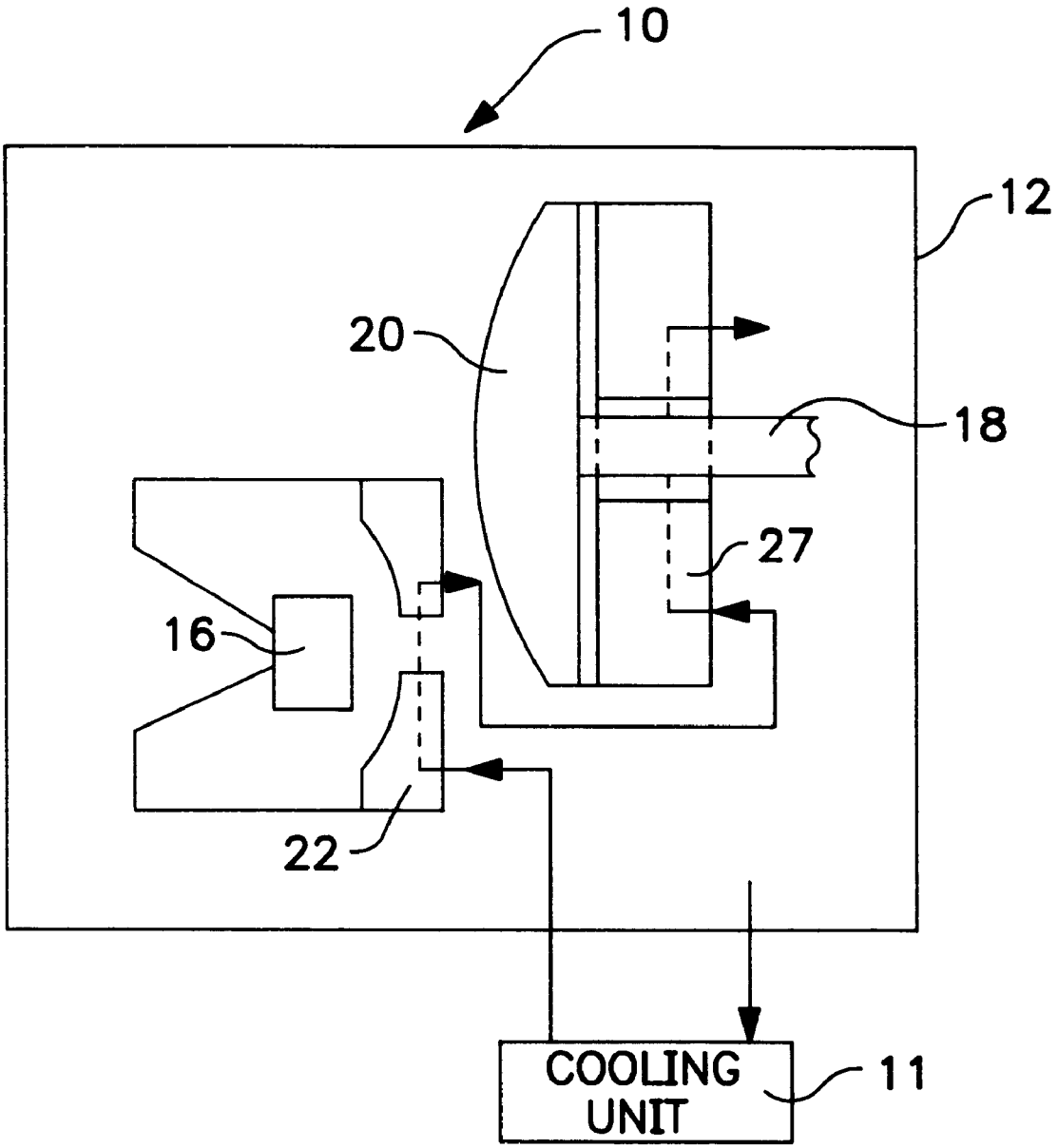
FIG. 5 is a schematic block diagram which shows circulating of the fluid coolant within the X-ray generating apparatus of the present invention.

FIG. 5 shows schematically a circulation of a fluid coolant according to the present invention which efficiently cools the X-ray generating apparatus of FIGS. 1 and 2. The hot cooling liquid from housing 12 is introduced into an external cooling unit 11. Conventional external cooling units comprising a heat exchanger and a pump for circulating the cooling fluid within the X-ray tube housing may be utilized for the present invention. Cooled fluid coolant is initially introduced into the interior of shield structure 22. After absorbing heat from shield structure 22 which receives heat from anode target 20, the cooling fluid is directed into the plurality of annular channels of the disk of cooling block 27 disposed behind anode assembly 18 to cool the forward protrusions through which heat is transferred from anode assembly 18. The cooling liquid is thereafter circulated inside housing 12 and is then directed into external cooling unit 11.

The invention has been described above with reference to the embodiments which are intended to be illustrative, not as limiting. Different modifications and variations are possible within the spirit of this invention. With the incorporation of the novel features according to this invention, X-ray generating apparatus can be operate under high energy scanning protocols of 1 million to 2 million joules and still improve patient throughout. All such modifications and variations that may be apparent to a person skilled in the art are intended to be within the scope of this invention.

What is claimed is:

1. An X-ray generating apparatus comprising:

a housing;

an evacuated envelope disposed within the housing;

an electron source capable of emitting electrons, that is disposed within the evacuated envelope;

an anode target disposed within the evacuated envelope spaced apart from the electron source; and a shield structure disposed between the anode target and the electron source, the shield structure having an aperture that allows electrons emitted from the electron source to pass to the anode target, the shield structure further comprising:

at least one fluid passageway formed within the shield, the at least one fluid passageway capable of receiving a fluid coolant from an external cooling unit; and a plurality of fins disposed within the at least one fluid passageway.

2. An X-ray generating apparatus as defined in claim 1, further comprising:

a cooling block disposed substantially adjacent to the anode target, the cooling block comprising a plurality of fluid passageways for receiving the fluid coolant emitted from the at least one passageway formed within the shield.

3. An X-ray generating apparatus as defined in claim 2, wherein the anode target includes a plurality of fins protruding towards the cooling block, and the cooling block includes forward protrusions towards the anode target, wherein the anode target fins are oriented to transfer heat to from the target anode to the cooling block through the protrusions.

4. The X-ray generating apparatus of claim 1, further comprising a metal foam disposed between at least some of the fins disposed within the fluid passageway of the shield.

5. The X-ray generating apparatus of claim 1, further comprising a plurality of metal spheres that are disposed within the fluid passageway of the shield.

6. The X-ray generating apparatus of claim 1, wherein at least some of the plurality of fins disposed within the fluid passageway include means for increasing the rate of heat transfer from the fins to the fluid coolant disposed within the fluid passageway.

7. The X-ray generating apparatus of claim 6, wherein the heat transfer means is comprised of an irregular surface formed on the outer surface of the fin so as to increase the wetted area on the fin.

* * * * *